United States Patent [19]

Leifheit et al.

[11] 4,039,083

[45] Aug. 2, 1977

[54] TIE HANGER

[75] Inventors: Günter Leifheit; Johannes Liebscher; Rainer Friedrich, all of Nassau (Lahn), Germany

[73] Assignee: Leifheit International Gunter Leifheit GmbH, Nassau (Lahn), Germany

[21] Appl. No.: 547,372

[22] Filed: Feb. 5, 1975

[30] Foreign Application Priority Data

Feb. 7, 1974 Germany ..... 2405756

[51] Int. Cl.[2] ..... A47F 5/08

[52] U.S. Cl. ..... 211/96; 211/168

[58] Field of Search ..... 211/1.3, 96, 94, 172, 211/48, 168, 88, 90, 45–47

[56] References Cited

U.S. PATENT DOCUMENTS

| | | | |
|---|---|---|---|
| 774,117 | 11/1904 | Tandy | 211/47 X |
| 1,345,624 | 7/1920 | Nelson | 211/1.3 |
| 1,818,761 | 8/1931 | Sendler | 211/1.3 |
| 1,899,942 | 3/1933 | Claflin, Jr. | 211/96 |
| 1,927,659 | 9/1933 | Hamer | 211/48 X |
| 3,580,396 | 5/1971 | Dietz | 211/168 X |

FOREIGN PATENT DOCUMENTS

| | | | |
|---|---|---|---|
| 1,311,983 | 11/1962 | France | 211/96 |
| 1,479,880 | 3/1967 | France | 211/96 |

*Primary Examiner*—Roy D. Frazier
*Assistant Examiner*—Terrell P. Lewis
*Attorney, Agent, or Firm*—Michael J. Striker

[57] ABSTRACT

A housing has an open front side, and one or more arms are provided, each having two ends and a length sufficient to permit a plurality of adjacent ties to be hung from the respective arm. Pivot pins mount these arms at one end within the housing so that the arms can be pivoted outwardly of the housing to an access position and can be pivoted into the housing to a storage position in which the opposite ends of the respective arms are supported on a portion of the housing.

10 Claims, 3 Drawing Figures

TIE HANGER

BACKGROUND OF THE INVENTION

The present invention relates generally to a tie hanger, and more particularly to a tie hanger having one or more tie-supporting arms.

Various kinds of tie hangers are already well known in the art, including a type having a plurality of pivotable arms which are located adjacent one another on a support and which, when access is desired to the ties, are pivoted to a position in which they extend at right angles to the support. The support is intended to be mounted on a door of a clothes closet, or in a similar position. Each of the arms has a length that is just sufficient to support a single tie, and the arms are spaced from one another in direction transversely of their pivot axes by a distance which is slightly longer than the length of the arms so that, when the arms are pivoted back against the support to a storage position, all of the arms will become located in a common plane with the free end of one arm being located adjacent the pivoted end of the next arm, and so on. An arrangement is provided which is coupled with all of the arms in order to pivot all of the arms simultaneously to the storage position or to the access position.

SUMMARY OF THE INVENTION

It is an object of the present invention to provide an improved tie hanger.

More particularly, it is an object of this invention to provide a tie hanger having one arm or a comparatively small number of arms, but capable of supporting a plurality of ties nevertheless.

Another object of the invention is to provide such a tie hanger wherein the ties can be moved to a readily accessible position without difficulties, and in particular without requiring a special arrangement for moving the arm or arms as is necessary in the prior art.

In keeping with these objects, and with others which will become apparent hereafter, one feature of the invention resides in a tie hanger which, briefly stated, comprises support means, an arm having two ends and a length sufficient to permit a plurality of adjacent ties to be hung from the arm, and mounting means mounting one end of the arm on the support means for pivotal movement of the arm relative to the support means about an upright axis between an access position in which the other end is remote from the support means and a storage position in which the other end is supported on the support means.

The single arm in the tie hanger according to the present invention, or the comparatively small number of such arms, can respectively support a rather large number of ties, thus eliminating the necessity for a large number of individual arms each of which was capable of supporting only a single tie, as in the prior art.

It is advantageous if each arm in the tie hanger according to the present invention has a cross-section resembling a flat rectangle standing on edge, and is provided at its upper edge with a plurality of receivers which are spaced from one another lengthwise of the arm and each adapted to accommodate a tie. Such a construction assures that the respective arm has a sufficient structural strength, and in addition it assures that there is a specifically detailed place for each tie.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figures 1, 2, 3:
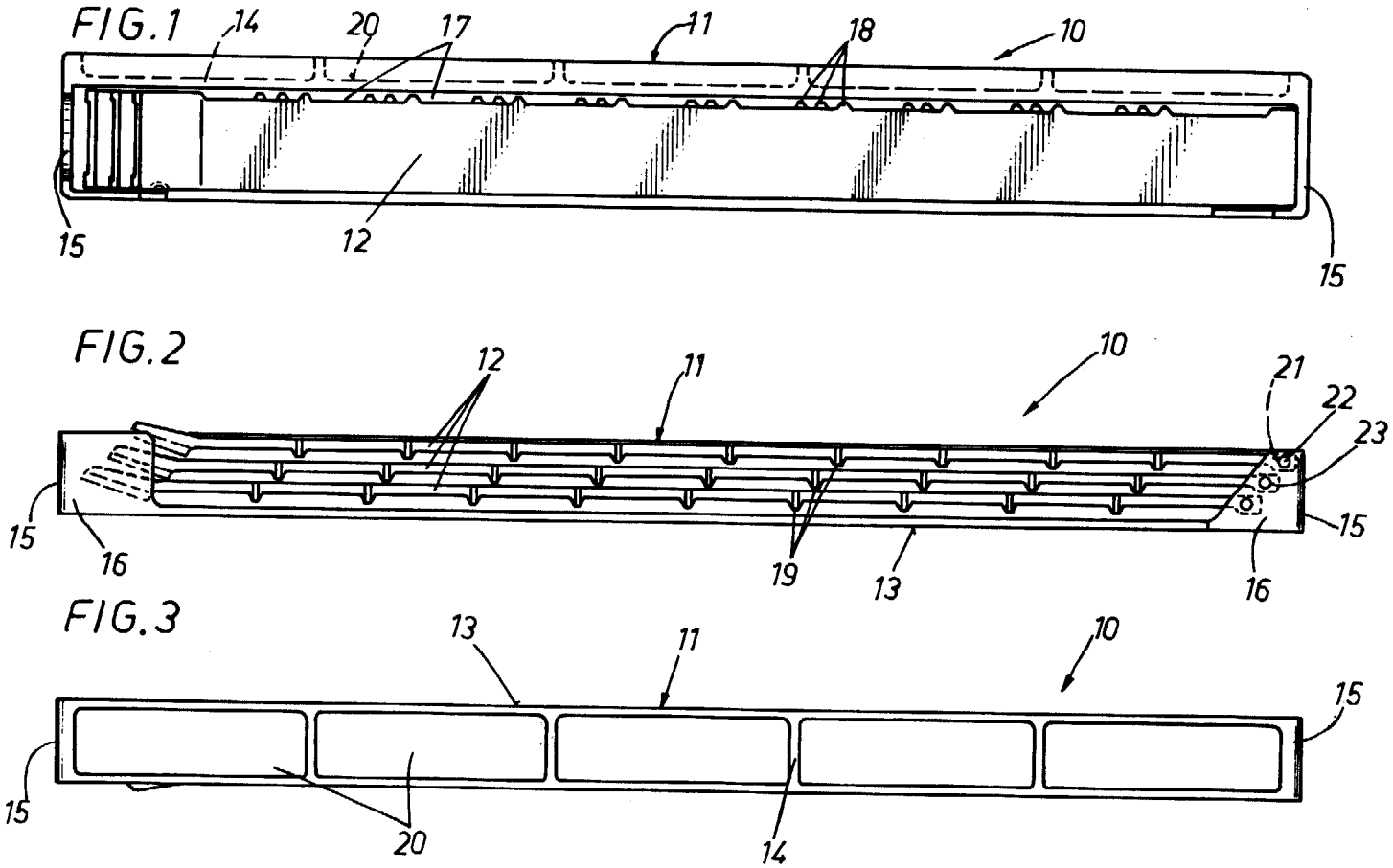
FIG. 1 is a front view of a tie hanger according to the present invention.
FIG. 2 is a bottom-plan view of FIG. 1.
FIG. 3 is a top-plan view of FIG. 1.

Referring now to the drawing in detail, wherein FIGS. 1–3 show a single exemplary embodiment of the novel tie hanger of the present invention, it will be noticed that reference numeral 10 identifies the tie hanger in toto. The tie hanger is to be mounted on closet doors, walls, or in any spot where it is desired to store the ties. It has s support 11 in form of a housing having an open side and adapted to be mounted on a closet door or the like, and is in the illustrated embodiment provided with three pivot arms 12 each of which serving to support a plurality of the ties (the latter are not illustrated). It is advantageous if the housing 11 is of synthetic plastic material; it has a closed back wall 13, an upper wall 12, two end walls 15 at the opposite ends of the housing, and two wall portions 19 which in effect constitute extensions of the end walls 15 and are located at the lower side of the housing, extending lengthwise of the wall 13 to only a slight extent, namely to such an extent that they will be located beneath and be capable of supporting the opposite ends of the arms 12.

As pointed out earlier, it is desirable that the arm or arms have a cross-section resembling a flat rectangle standing on edge; the other edges of the respective arms 12 are provided with a plurality of receivers 17 which are spaced lengthwise of the respective arms 12 and are each adapted to receive and retain one tie. The receivers 17 are bounded by tranversely extending projections or ribs 18 which merge into vertically extending ribs 19 located at the rear sides of the respective arms 12, that is at those sides of the arms 12 which will face the back wall 13 when the arms 12 are in the storage position in which they extend parallel to the back wall 13. The provision of the ribs 18 and 19 assures that the ties which are placed into the receivers 17 will be retained on the arms in a predetermined position and will be unable to shift thereon.

The upper side of the upper wall 14 is advantageously provided with a plurality of depressions 20 in which a user may store small items, such as tie tacs, collar stays, cufflinks or even coins.

Each arm 12 is provided at one end with a vertical bore or passage 21 in which a pivot pin 22 is received. One of the wall portions 16 and one end of the wall 14 are provided with a pair of registering bores or passages 23, and the end of the arm 12 will be so inserted between these passages 23 that the bore 21 will register with the passages 23 so that the opposite axial ends of the pivot pin 22 which project out of the bore 21 will be lodged in the bores 23. The arrangement for the different arms 12 is so chosen that the several pivot pins 22, one for each arm, are located on a common line which includes an angle of 45° with the surface of the support on which the tie hanger 10 is mounted which can also be expressed by saying that it includes an angle of 45° with the rear wall 13. The front one of the pivot pins 22, that is the one that is farthest forward from the rear wall 13, is closest to the adjacent end wall 15; the spacing between two adjacent ones of the pivot pins 22 equals at least 1.4 two times the thickness of the arms 12, thereby assuring that each of the arms 12 can be pivoted through 90° from its storage position to an access position in which it extends normal to the rear wall 13, thus making access to the respective ties very simple.

The free end of the foremost arm 12, that is the one that is farthest outwardly from the rear wall 13, may be provided with a detent portion (not shown) that can engage with a cooperating detent portion provided on the bottom wall portion 16 that is remote from the one provided with the bore 23. Thus, when these detent portions engage one another, for example by a snap action or the like, the foremost arm 12 will itself be held in place against undesired movement, and will in turn hold the other arms in place also. To move the arms 12 from storage position to access position it is merely necessary to exert a slight tug on the free end of the respective arm, or perhaps to lift up the free end of the respective arm slightly, depending upon the type of detent portions chosen. To facilitate a gripping of the arms and their movement from storage position to access position it is advantageous if the free end portions of the respective arms 12 are slightly angled in direction away from the rear wall 13, and the end wall 15 adjacent the free ends of the arms 12 may be provided with a cutout (not shown) to facilitate engagement of the respective free end portions.

The arms 12 themselves may be of synthetic plastic material, and the ribs 18 and 19 may be produced at the same time as the arms are produced, for example by molding.

It will be appreciated that various modifications are possible in the exemplary embodiment that has been described and illustrated herein, without in any way departing from the scope and intent of the invention. For example, the arms 12 could be connected with one another by appropriate coupling portions in such a manner that when the foremost arm 12 is moved from storage position to access position in which it extends at an angle of up to 90° relative to the back wall 13, the arms 12 which are located behind it will automatically also move towards access position after the foremost arm 12 has travelled partway toward its own access position. The pivot pins 22 need self-evidently not be separate elements, but could be in the form of projections that are directly formed (e.g. by molding) on the ends of the arms 12. Equally clearly, such projections could be formed on the upper wall 14 and one of the lower wall portions 16, and might be snapped into depressions formed on one end of each of the arms 12. It is not necessary that three of the arms 12 be provided, although this is currently considered to be an advantageous embodiment because it permits a large number of ties to be stored; evidently, more than three of the arms might be provided, or only two or even a single arm 12 could be utilized. It would also be possible to use arms which each have a length slightly less than half the length of the housing 11, one set of these arms being pivoted in the manner described with reference to FIGS. 1-3 at one end of the housing, and the other set being pivoted in the same manner but at the opposite end of the housing, so that the free ends of the two sets of arms would be located adjacent to one another if the arms are in storage position.

It will be understood that each of the elements described above, or two or more together, may also find a useful application in other types of constructions differing from the types described above.

While the invention has been illustrated and described as embodied in a tie hanger, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A tie hanger, comprising support means in form of a housing; at least two arms each having two ends and a length sufficient to permit a plurality of adjacent ties to be hung from said arms; mounting means mounting one end of each arm on said support means for pivotal movement of said arm relative to said support means about an upright axis between an access position in which the other end is remote from said support means and a storage position in which the other end is supported on said support means; and detent means on said housing and on the other end of at least one of said arms.

2. A tie hanger, comprising support means in form of a housing; at least two arms having two ends and a length sufficient to permit a plurality of adjacent ties to be hung from said arms; mounting means mounting one end of each arm on said support means for pivotal movement of said arm relative to said support means about an upright axis between an access position in which the other end is remote from said support means and a storage position in which the other end is supported on said support means, said other end of each of said arms being angled relative to the associated arm in a direction in which it faces away from said support means when said other end of said arms is in said storage position.

3. A tie hanger mountable on a supporting surface and comprising a housing having a back wall adapted to be mounted on said supporting surface, an upper wall, two end walls, and two lower wall portions extending substantially parallel to said upper wall downwardly spaced therefrom, said walls defining therebetween an opening; a plurality of arms each having two spaced ends and a length sufficient to permit a plurality of adjacent ties to be hung from said arms, each of said arms being pivotally mounted in said housing by one end of said arm and being pivotable through said opening between an access position in which the other end of said arm is remote from said housing and a storage position in which the other end is supported by said housing, said arms each having a length and a height corresponding substantially to the length and the height of said opening; and means for pivotally mounting said one end of each of said arms in said housing.

4. A tie hanger as defined in claim 3, wherein each of said arms has a cross-section resembling a flat rectangle standing on edge, and includes an upper edge formed with a plurality of receivers for ties.

5. A tie hanger as defined in claim 4, wherein said receivers are depressions defined between ribs provided on said upper edge.

6. A tie hanger as defined in claim 5, wherein each of said arms also has a front side facing the user when the arm is in said storage position, and a rear side, said upper edge extending between said sides; and further comprising upright ribs on said rear side defining therebetween a further plurality of upright receivers for ties on said rear side, each of said upright ribs on said rear side constituting an extension of one of said ribs on said upper edge of said arm so that each of said upright receivers on said rear side merges into one of said receivers on said upper edge of said arm.

7. A tie hanger as defined in claim 3, wherein said one end is formed with a vertical bore, said support means being formed with vertically spaced bores which register with one another and with said bore of said one end; and wherein said mounting means comprises a pivot pin received in said bores.

8. A tie hanger as defined in claim 3, wherein each of said arms has an upper edge, and said upper wall having a lower side facing said upper edge of said arms and an upper side opposite to said lower side, said upper wall of said housing being located so that said lower side thereof is adjacent to said upper edge of said arms and being provided with a plurality of depressions formed in said upper side thereof.

9. A tie hanger as defined in claim 3, wherein said mounting means comprises a pivot pin for said one end of each of said arms, said pivot pins being located on a line which includes with said back wall an angle of 45°.

10. A tie hanger as defined in claim 9, said pivot pins being located adjacent one of said end walls and including a front pin closer to and a rear pin farther from said one end wall, the distance along said line between the adjacent pins being equal to at least 1.42 times the thickness of said arms.

* * * * *